United States Patent [19]

Durville

[11] 4,417,455

[45] Nov. 29, 1983

[54] MACHINE FOR THE PRODUCTION OF KNITTED GOODS AND METHOD OF THE MACHINE

[75] Inventor: Gerard Durville, Sisseln, Switzerland

[73] Assignee: Textilma AG, Switzerland

[21] Appl. No.: 165,498

[22] Filed: Jul. 3, 1980

[30] Foreign Application Priority Data

Jul. 4, 1979 [CH] Switzerland ..... 6236/79
Jul. 30, 1979 [DE] Fed. Rep. of Germany ..... 2930824

[51] Int. Cl.[3] ..... D04B 23/00
[52] U.S. Cl. ..... 66/207; 66/84 R
[58] Field of Search ..... 66/84 R, 203, 207, 116, 66/119

[56] References Cited

U.S. PATENT DOCUMENTS 4,007,609 2/1977 Zorini ..... 66/116
4,009,597 3/1977 Wall et al. ..... 66/193

FOREIGN PATENT DOCUMENTS 1075266 2/1960 Fed. Rep. of Germany ..... 66/84 R
1058486 2/1967 United Kingdom ..... 66/203
1065892 4/1967 United Kingdom ..... 66/203
1430246 3/1975 United Kingdom ..... 66/203
1430421 3/1975 United Kingdom .
1527123 10/1978 United Kingdom ..... 66/203

OTHER PUBLICATIONS

Weber K. P., "Die Wirkerei und Strickerei" 1974, pp. 139–140.
Kruder, K. "Hochleistungs-Häkelgalonmaschinen" 1969, No. 2 pp. 170–176.
Paling, D. F., "Warp Knitting Technology", 2nd Ed., 1965 London, Columbine Press, p. 173 (FIG. 134 j): p. 84, FIG. 47(a).

*Primary Examiner*—Ronald Feldbaum
*Attorney, Agent, or Firm*—McGlew and Tuttle

[57] ABSTRACT

A weft knitting machine includes a row of crochet needles and two rows of thread guides for guiding a respective basic warp thread or additional warp thread. Basic warp thread guides and additional warp thread guides are each attached to a carrier, of which one is fastened to a hollow rod and another to an inner rod arranged in this. Both the rods pivotable together about the same axis and displaceable along this axis independently of each other. The additional warp thread guides are moved in such a manner that each additional warp thread is laid alternately around one of two neighboring needles in the same direction of rotation. In this manner, a knitted article is formed which does not ravel on the tearing of a thread and which is produced on a machine equipped with crochet needles wherein the additional warp threads can also still form wale loops.

14 Claims, 16 Drawing Figures

MACHINE FOR THE PRODUCTION OF KNITTED GOODS AND METHOD OF THE MACHINE

FIELD AND BACKGROUND OF THE INVENTION

This invention relates in general to knitting machines and methods and, more particularly, to a new and useful machine for the production of knitted goods having means for displacing at least two groups of thread guides around a common pivot axis and for displacing the groups of thread guides relative to each other along the pivot axis and a method of operating the machine.

U.S. Pat. No. 4,009,597 discloses a warp knitting machine, for the production of knitted goods, which includes a row of tongue needles, that is, needles which at one end of their shank have an opening which is partially bounded by a tongue articulated to the shank. A warp thread guide is provided for each needle. The warp thread guide, in operation, lays a warp thread around the needle into the opening thereof so that a stitch loop chain is formed out of each warp thread. Weft thread guides are provided, through which the weft threads are laid in, which extend transversely to the stitch loop chains and connect these with one another. Furthermore, two thread guides are provided for weaving, at both longitudinal edges of the knitted articles respectively, an additional thread into the outermost pair of stitch loop chains. Both of these additional threads prevent ravelling of the finished knitted article on the tearing of a thread disposed at the edge. Each of both these additional threads is laid around the two outermost needles each time a row of stitches lying beside one another is formed.

The thread guides for the warp thread and those for guiding the mentioned additional threads are secured to different bars. Drive means not particularly described move these two bars in such a way that a knitted portion of the above mentioned kind is formed of the warp threads and the additional threads. Thus, presumably, the drive means comprise a separate shifting and separate pivoting mechanisms for each of the bars, wherefore they are relatively complicated. Therefore, at each of the longitudinal edges of the knitted article, a formation of double stitches is made during each stitch formation at both the outermost stitch loop chains.

Such a formation of double stitches is however only possible when the machine is equipped with tongue needles as already mentioned. Certain types of machines are, however, equipped with crochet needles, that is, with needles which at one shank end include an elastically deformable hook, which is contiguous with the shank and the free end of which is bent back to the shank and bears resiliently on one side thereof. It is not possible on a machine, which displays crochet needles of that kind, to lay an additional thread into two needles in the same operating cycle in such a manner that double stitches of the previously known kind are formed.

When the stitch loop chain pairs, disposed at both longitudinal edges of an article, are connected with one another only through a respective woven-in additional thread, the knitted article is not reinforced in its interior between these edges. Although U.S. Pat. No. 4,009,597 discloses that additionally double stitches could be formed also in interior stitch loop chains, that is, not lying at the edge, this method would also, however, still have the disadvantage that the stitch loop chains are continuously connected only, in pairs, with one another by the additional threads over the entire length of the knitted article. Thus, if the different stitch loop chain pairs were then also connected with one another only by the weft threads, which would for example be unfavorable in a wale tape for the formation of a closure with two tapes which display wale loops that are hookable into one another.

Furthermore, in British patent specification No. 1,527,123, there is a knitting method, in which stitch loop chains formed of basic warp threads are connected with one another by weft threads extending transversely to them and additionally by additional warp threads which are alternately worked into the stitches of two different stitch loop chains. In that case, the basic warp threads, as well as the additional warp threads, are alternately laid in different rotational sense around the needles. Such a manner of operation is, however, likewise not possible with crochet needles, but only with needles which display either an articulated tongue or a slide.

SUMMARY OF THE INVENTION

In the machine of the present invention it is possible to work warp threads connecting different stitch loop chains with one another into a knitted article without the necessity of the needles having an articulated tongue or a displaceable slide. In that case, the machine shall additionally make it possible to connect a stitch loop chain by warp threads with both stitch loop chains disposed on different sides thereof.

In accordance with the invention, an improved machine for the production of knitted goods is provided. The machine is of the type having needles, at least two groups of thread guides for laying a thread around a needle, means for supporting and driving the groups of thread guides to warp a respective thread around each needle in order to form stitches, the support and drive means being constructed in a manner so that two different threads are wrapped around the same needle by respective thread guide of each group of the thread guides and at least one of the two different threads being wrapped alternately around different needles during the formation of successive stitches. The improvement includes, in combination with the machine, means for pivotally mounting the groups of thread guides around a common pivot axis and for axially displacing the groups of thread guides relative to each other along the pivot axis. The groups of thread guides are nonrotatably connected to each other.

It is an object of the present invention to provide an improved machine for the production of knitted goods, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 2:
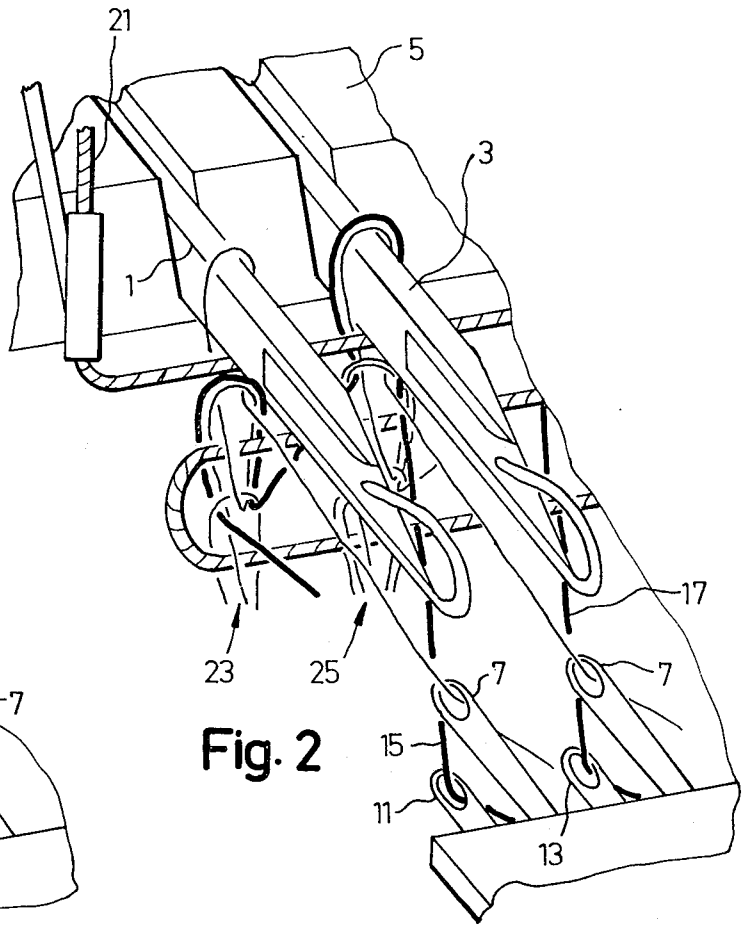
FIGS. 1 to 8 are exonometric views of the elements of a crocheting machine for the formation of two stitch rods or loop chains, in different operating phases.

A weft knitting machine or more precisely a machine for warp knitting with the insertion of weft threads, namely a modified crocheting machine, includes a row of chrochet needles, of which the two outermost ones are evident in the FIGS. 1 to 8 and designated by reference numerals 1 and 3. All the needles are displaceably guided, in parallel to one another, in grooves of a carrier 5, which is fastened to the frame of the machine. A basic warp thread guide 7 is provided for each needle. The guide 7 guides a basic warp thread 9.

Furthermore, a number of additional warp thread guides 11 and 13 are present, each of which guides an additional warp thread 15 and 17, respectively. A weft thread guide 19 is provided for the guidance of a weft thread 21.

It is to be noted that the different threads are illustrated in the drawings with different thicknesses to improve their distinctiveness. The threads can, in reality, either all be equally thick or have other thickness relationships.

A respective stitch loop chain 23 and 25 is produced during the operation of the machine, from each basic warp thread 9, of which the stitch loop chain 23 forms the lefthand longitudinal edge of the knitted article. Furthermore, a section of the weft thread is, during each stitch formation, laid transversely to the stitch loop chains into their stitches so that it connects all stitch loop chains with one another. Every additional warp thread 15 and 17 is worked into the knitted article in such a manner that it extends in zig-zag between two neighboring stitch loop chains and alternately forms an additional stitch in these.

The crochet needles are also arranged that their hooks can be opened at the top and the free ends of the hooks are disposed on the lefthand side of the needle shanks. Accordingly, all warp threads, during each stitch formation, are laid around the needles always in a like rotational sense, namely in the clockwise sense.

The knitting method shall now be explained by reference to the FIGS. 1 to 8, which in the sequence of the figure numbers show states following one another in time.

Figure 1:
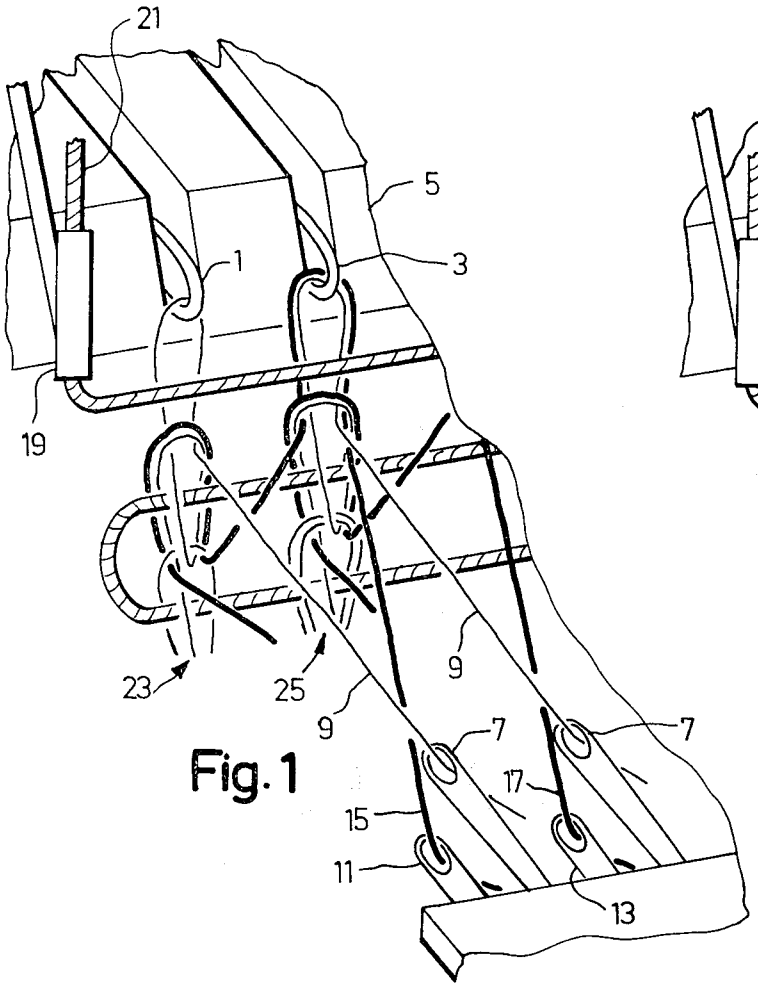

In the state represented by the FIG. 1, the needles 1 and 3 are fully withdrawn, that is, furthest removed from the warp thread guides 7, 11 and 13. All warp thread guides 7, 11 and 13, or, more accurately stated, their guide openings, are disposed in their lowest settings disposed furthest to the left. The weft thread guide 19 is likewise disposed in its lowest setting disposed furthest to the left. The last processed section of both the basic warp threads 9 form a respective loop hooked into the hooks of the needles 1 and 3. The last processed section of the additional warp thread 15 forms a loop hooked into the hook of the needle 3. The weft thread section last laid in extends over the loops hooked into the needles.

At the instant illustrated in the FIG. 2, the needles 1, 3 are moved forwardly against the warp thread guides. On the advancing of the needles, the loops, which have previously been hooked into their hooks and which are retained by the weft thread section last laid in, have gone onto the shanks of the needles. The basic warp thread guide 7 was raised somewhat so that the basic warp thread sections guided by it are disposed to the left of the associated needle. The additional warp thread guides 11 and 13 were likewise raised so that the additional warp thread guide 11 is disposed to the left of the prolongation of the needle 1 and the section of the additional warp thread 15, which extends from the additional warp thread guide 11 to the knitted article, runs through below the needle 1. The additional warp thread 17 correspondingly extends through below the needle 3.

Figure 3:
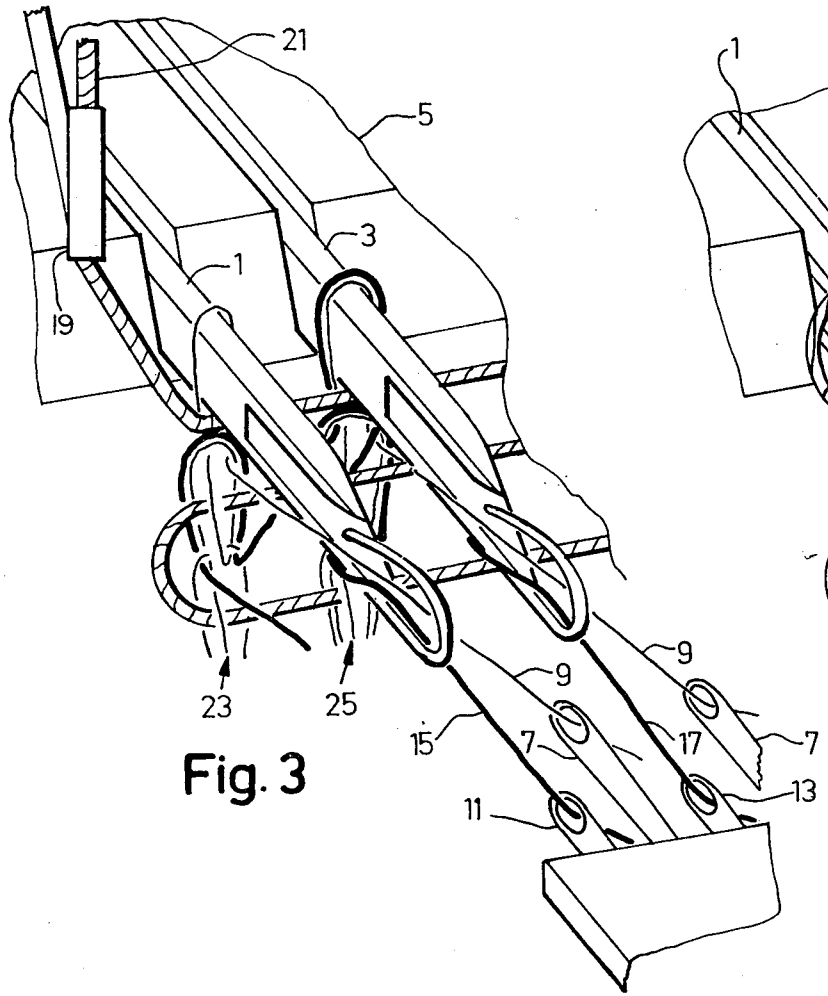

FIG. 3 shows the state shortly after the instant, at which the needles 1 and 3 are disposed furthest forward. The needles are thus now again displaced rearwardly. The basic warp thread guides 7 were, after the attainment of their highest setting, first displaced to the right and now again move downwardly. Thereafter, the basic warp threads 9 were drawn between the free hook ends and the shanks of the needles 1 and 3 through into the hooks of the latter. The additional warp thread 15 was in corresponding manner drawn into the hook of the needle 1 and the additional warp thread 17 into the hook of the needle 3. The weft thread guide 19 was raised through the needles 1 and 3 are now begins to move to the right.

Figure 4:
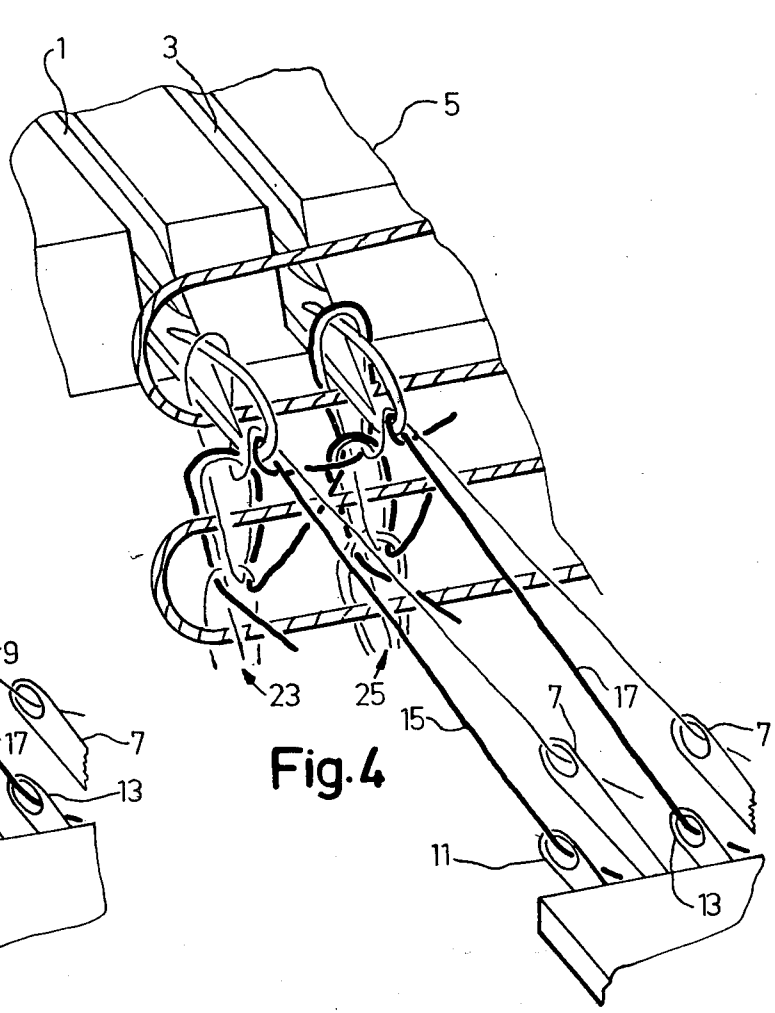

At the instant illustrated in the FIG. 4, the needles 1 and 3 continue their rearward displacement directed away from the warp thread guides. In that case, the hooks draw the thread sections laid into them through the loops previously lying on the needle shanks. The warp thread guides 7, 11 and 13 meanwhile move further downwardly. The weft thread guide moves further to the right against the righthand longitudinal edge of the knitted article and in that case lays a weft thread section over the needles. The additional warp thread 15 now forms a loop hanging in the hook of the needle 1 and the additional warp thread 17 a loop hanging in the hook of the needle 3.

Figure 5:
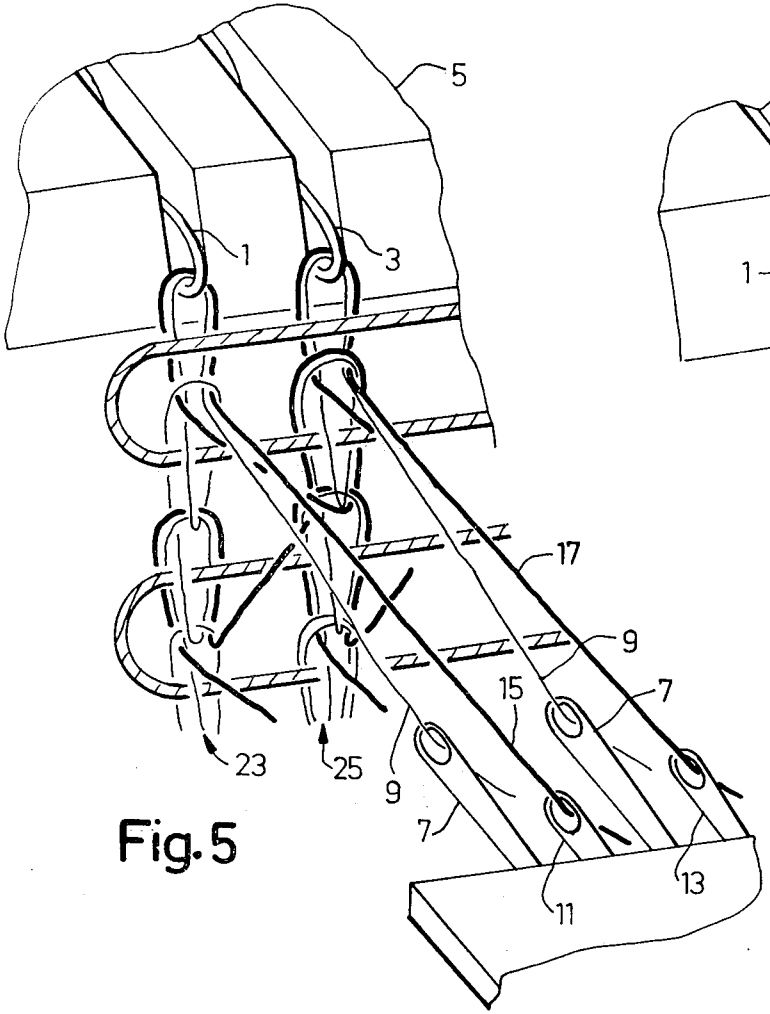

In the state illustrated in the FIG. 5, the needles 1 and 3 have again attained their rearmost settng furthest removed from the warp thread guides. The loops, which in the FIG. 3 were disposed on the needle shanks, have now been cast off by the needles and form finished stitches. The warp thread guides 7, 11 and 13 are disposed in their lowermost setting. The not visible weft thread guide has reached the righthand longitudinal edge of the knitted article and now begins again to move to the left.

Figure 6:
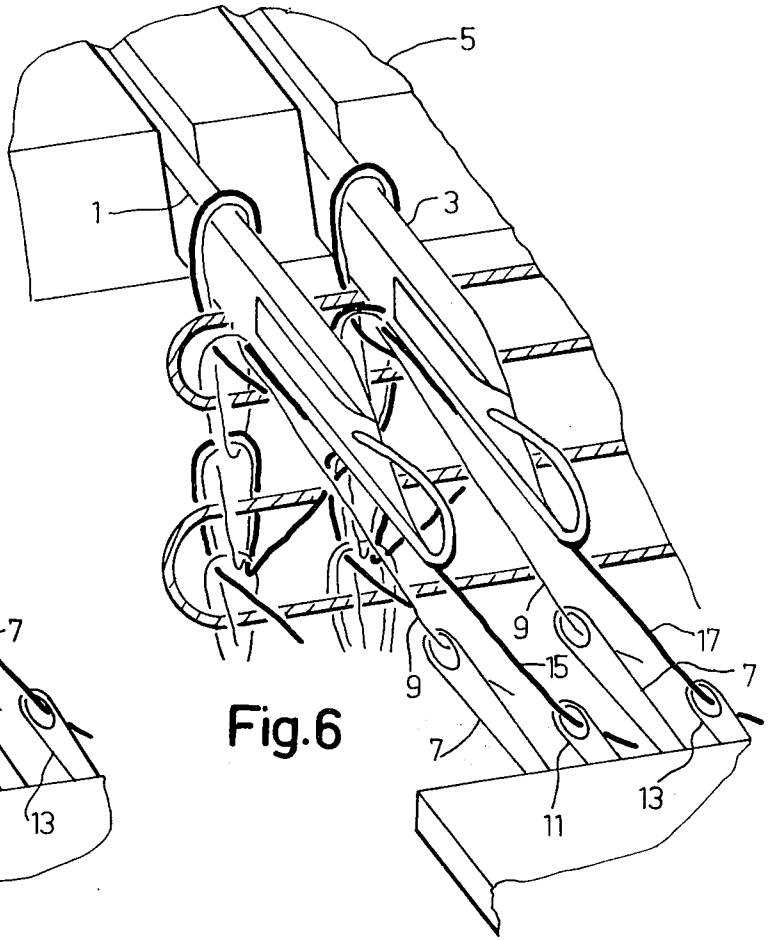

At the instant illustrated in the FIG. 6, the needles 1 and 3 again move forwardly towards the thread guides 7, 11 and 13. The basic warp thread guides 7 have in the meantime moved somewhat to the left and now begin to move upwardly so that the basic warp threads 9 are drawn through below the associated needles 1 and 3 to the lefthand needle side. The additional warp thread guides 11 and 13 thereagainst move upwardly without preceeding leftward displacement so that the section of the additional warp thread 15 guided by the thread guide 11 gets beside the needle 3 at the left.

Figure 7:
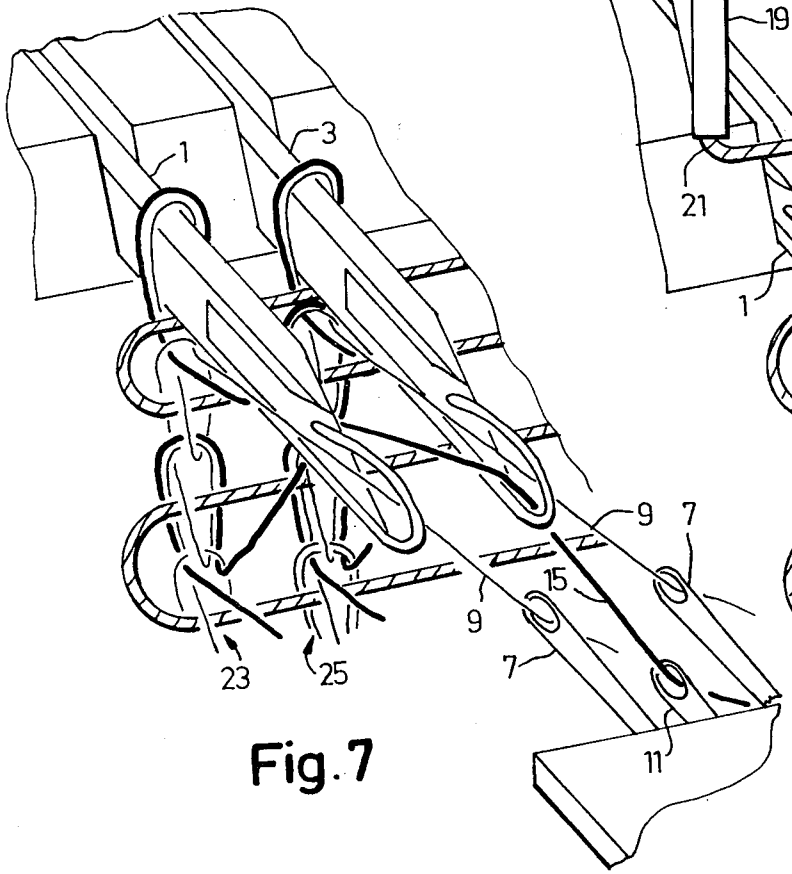

In the state evident in the FIG. 7, the needles 1 and 3 are approximately in their foremost setting. The thread guides 7, 11 and 13 have in the meantime first displaced upwardly into their highest setting and then again towards the right and now again move downwardly. Thereby, the basic warp threads are again laid into the hooks of the associated needles. Furthermore, the additional warp thread 15 was laid into the hook of the needle 3. The not visible weft thread guide in the meantime moves towards the left over the needles.

Figure 8:
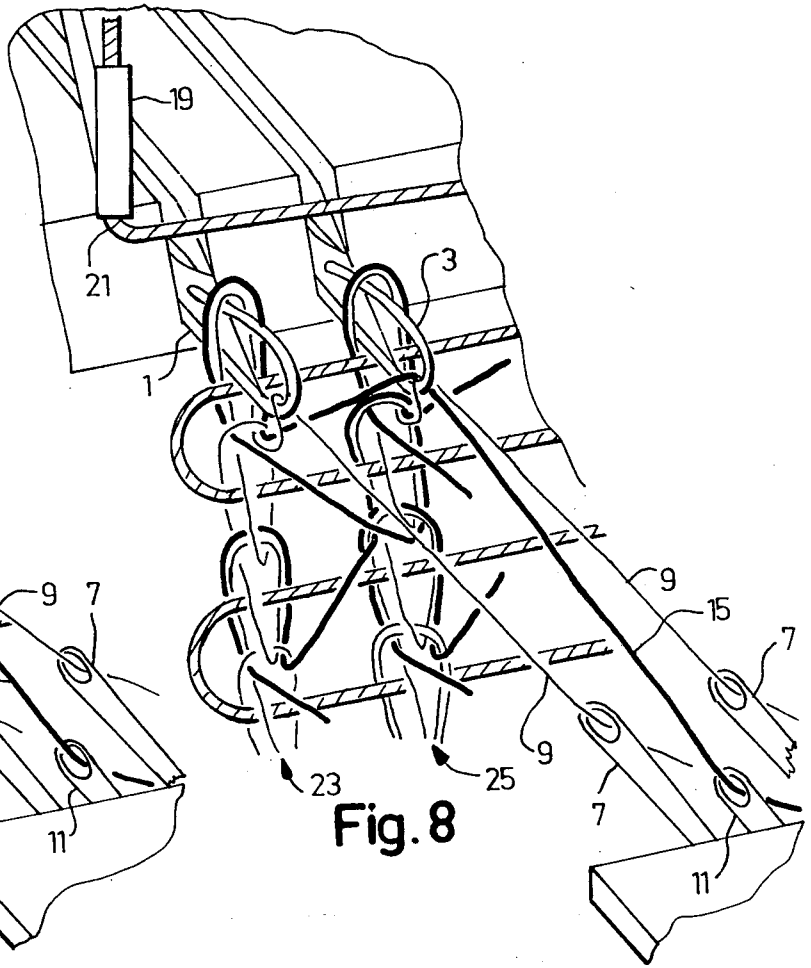

At the instant illustrated in the FIG. 8, the needles 1 and 3 are displaced rearwardly and stand shortly before the attainment of their rearmost setting. The needle 1 draws the basic warp thread hooked into its hooks through the loops which were previously disposed on its shank. The needle 3 draws the basic warp thread 9 and additional warp thread 15 hooked into its hook through the loops disposed on it. The weft thread guide 19 has in the meantime again been displaced up to approximately its lefthand end setting. All warp thread guides have again approximately reached their lowermost setting and displace towards the left.

In the following operating phase, the needles and thread guides again move into the settings illustrated in FIG. 1. In that case, the loops, which were previously disposed on the needles, are cast off, whereby an operating cycle is completed.

In a complete operating cycle, two new stitches are thus formed from every basis warp thread 9. The additional warp thread 15 is, during the formation of the basic warp thread stitches, alternately worked into a stitch of the stitch loop chain 23 and of the stitch loop chain 25 and thus extends in zig-zag, to and fro, between these stitch loop chains. In the outermost stitch loop chain 23, there then follow, alternating each time a stitch formed out of only one basic warp thread 9 on a stitch formed out of the basic warp thread 9 as well as also of the additional warp thread 15.

The additional warp thread 17 is, analogously as the additional warp thread 15 alternately, worked into the stitch loop chain 25 and the stitch loop chain disposed at the right of this and no longer visible in the FIGS. 1 to 8. In the case of the stitch loop chain 25, either the additional warp thread 15 or the additional warp thread 17 is thus worked alternately into each stitch formed by the basic warp thread 9 concerned. The additional warp thread 15 connects the stitch loop chain 25 with the stitch loop chain 23 and the additional warp thread 17 connects the stitch loop chain 25 with the stitch loop chain disposed at the right of this and no longer visible in the FIGS. 1 to 8. The corresponding applies also for all remaining interior stitch loop chains, that is, not disposed at the edge.

Through this construction of the knitted article, it can be prevented practically completely that stitch loop chains become undone upon the tearing of threads.

Figure 9:
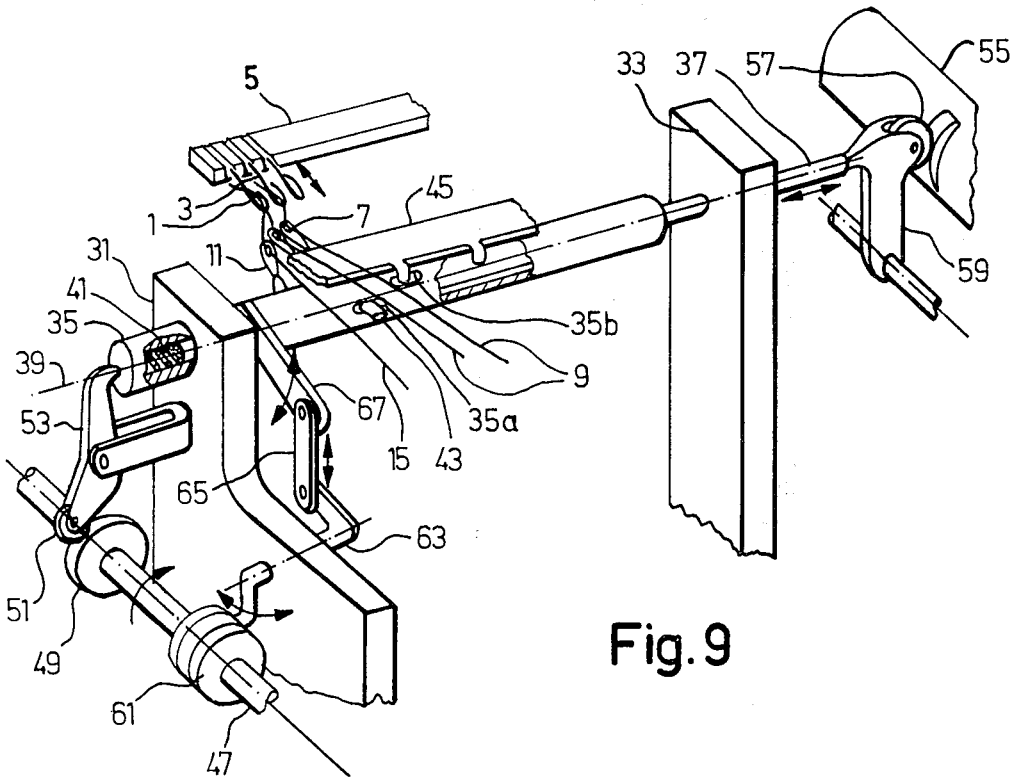
FIG. 9 is a schematic, exonometric view of a part of a crocheting machine with the retaining and drive means serving for the retention and movement of the warp thread guides.

In the performance of the production method illustrated by reference to the FIGS. 1 to 8, the additional warp thread guides are simultaneously with the basic warp thread guides moved up and down about transversely to the needle rows, but displaced in the direction of the needle rows in a manner different from the basic warp thread guides. FIG. 9 now shows part of a crocheting machine which makes such a movement of the warp thread guides possible. The machine has a row of crochet needles, which are arranged, in parallel, one beside another, and of which only a part is illustrated. These needles are guided displaceably in the carrier 5 fastened to the machine frame. The machine frame has two supports 31 and 33. A first elongated member, in this case, hollow rod 35 and a second elongated member, in this case, inner rod 37, projecting into the latter, are guided to be pivotable about the common axis 39 on supports 31 and 33, and displaceable along this axis 39. Arranged in the hollow space of the hollow rod 35 is a spring 41 which exerts a force on both the rods urging these away from each other.

The hollow rod is provided with a slot 35*a*, which extends along its axis and through which projects a pinshaped entraining member 43, which is fastened to the inner rod 37 and connects both the rods 35 and 37 with each other to be secure against rotation, but which permits axial displacement relative to each other. The hollow rod 35 is additionally provided with another slot-shaped opening 35*b* extending in its longitudinal direction. A rodshaped carrier 45 is fastened through the openings 35*b* to the inner rod 37 in such a manner that it does not obstruct the displacement of both the rods relative to each other. A basic warp thread guide 7, which guides a basic warp thread 9, for each needle, is fastened to the carrier 45. A similar carrier (not shown) is likewise fastened to the lower side of hollow rod 35. The additional warp thread guides, of which only the additional warp thread guide 11 guiding the additional warp thread 15 is illustrated, are fastened to the carrier on the lower side of rod 35. For the remainder, the additional warp thread guides are like the basic warp thread guides and needles arranged equidistantly in a straight row, in which neighboring additional warp thread guides have the same spacing as neighboring needles.

A shaft 47 rotatably journalled in the frame carries a cam or dog disc 49, which is scanned by the feeler roller 51 of a lever 53 which is pivotably mounted on the frame and which also engages at one end of the hollow rod 35. A dog shaft 55, rotatably journalled in the frame, is scanned by the feeler roller 57 of a lever 59 pivotably mounted in the frame. This engages at the inner rod 37, and namely at that rod end which projects out of the hollow rod 35 at the hollow rod and remote from the lever 53.

Connected to the shaft 47 is a cam disc 61, which engages a crank 63, the pivot axis of which extends parallel to the axis 39. The crank 63 engages, through a thrust rod 65 and a pivot arm 67, the hollow rod 35.

During operation of the machine, all needles are alternately displaced forwardly and rearwardly in their longitudinal direction with one another by a not illustrated drive device. Furthermore, the weft thread guide 19, not illustrated in the FIG. 9, is moved by a drive device transversely to the needles 1 and 3 in the manner explained by reference to FIGS. 1 to 8. The rods 35 and 37 are displaced to and fro along the axis 39 by the dog disc 49 and the dog shaft 55 and pivoted around the axis 39 by the cam disc 61 so that the motional course results as described by reference to FIGS. 1 to 8.

Figure 10:
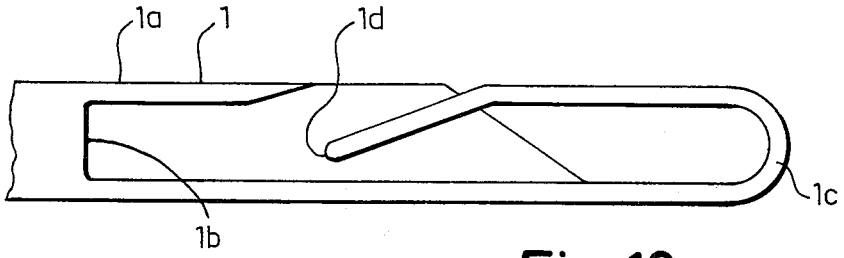
FIG. 10 is a side view of a crochet needle to enlarged scale.
Figure 11:
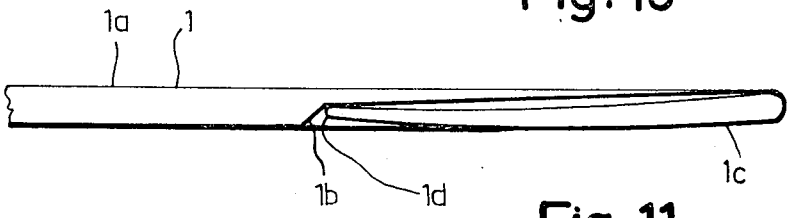
FIG. 11 is a plan view onto the crochet needle.

As already mentioned, in the case of the needles 1 and 3, crochet needles are used, which are also designated "twisted beard", carbine or patent needles. The needle 1 is illustrated separately in FIGS. 10 and 11. It has a shank 1*a*, which is rectangular in cross-section and which, at its forward end, is provided on one wide side with a depression or recess 1*b*. The hook 1*c*, disposed at the right hand needle and in FIGS. 10 and 11, is elastically flexible and U-shaped. The one U-limb is contiguous with the shank 1*a* at the one narrow side thereof. The free end 1*d* of the other U-limb projects into the recess and can bear under bias against the boundary surface thereof so that in the viewing direction of the length direction of the shank 1*a*, it lies completely within the rectangle which in the main part of the shank 1*a*, adjoining the recess 1*b*, forms the outline thereof. Thereby, it is assured that a thread loop, which is disposed on and looped around the shank 1*a*, on being casting-off, securely slides over the hook 1*c*. The remaining crochet needles of the machine are constructed identically as the needle 1.

Figure 12:
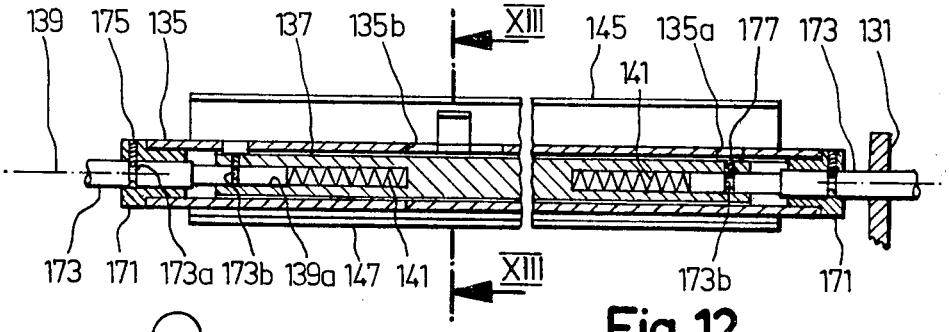
FIG. 12 is a longitudinal section through a modification of the rods for the retention of the warp thread guides.
Figure 13:
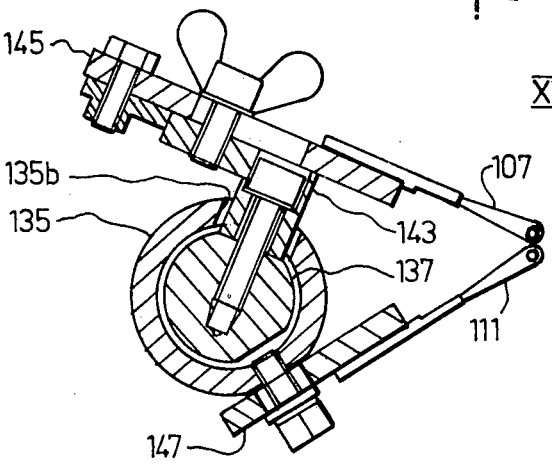
FIG. 13 is a section along the lines XIII—XIII of the FIG. 12 to enlarged scale.

In the machine modification illustrated in FIGS. 12 and 13, a hollow rod 135 is provided at both the ends of which is fastened a bush 171, each of which has a radially threaded bore. An inner rod 137 is arranged in the hollow rod 135. Both ends of the inner rod 137 have a blind bore 139*a* as well as a radially threaded bore opening into the blind bore 139*a*. A spring 141 is arranged in each of these blind bores 139*a*. Furthermore, a rod 173 projects into each blind bore 139*a*. These rods 173 are each mounted rotatably and displaceably in a support 131 of the frame and in their turn guide the bushes 171 and the inner rod 137 to be displaceable along the axis 139. Furthermore, each rod 173 has two annular grooves 173*a* and 173*b*. Screwed into the radially threaded bore of the bush 171 disposed at the lefthand hollow rod end is a screw 175, the inner end of which projects into the annular groove 173*a* of the rod 173 disposed at the left. Screwed into the threaded bore disposed in the righthand half of the inner rod 137 is a screw 177, which engages into the annular groove 173*b* of the rod 173 disposed at the right. The screw 175 thus connects the lefthand rod 173 non-dispensably with the hollow rod 135, while the screw 177 connects the righthand rod 173 non-displaceably with the inner rod 137. The hollow rod 135 is provided with an opening 135*a* in the region of the threaded bores present in the inner rod 137. One could thus displace the screw 175 to the righthand end of the hollow rod 135 and the screw 177 into the lefthand half of the inner rod 137 and thereby connect the lefthand rod 173 with the inner rod 137 and the righthand rod 173 with the hollow rod 135.

The hollow rod 135 is furthermore provided with slot-shaped elongate openings 135*b*. A carrier 145 is connected by spigots 143 and screws through the opening 135*b* in such a manner with the inner rod 137 that both the rods 135 and 137 are displaceable relative to each other along the axis 139. The rods 135 and 137 are, however, connected with each other substantially secure against rotation by the spigots 143 or another entraining member. A row of basic warp thread guides 107 are fastened to the carrier 145. Fastened to the hollow rod 135 is a carrier 147, to which a row of additional warp thread guides 111 is fastened.

Both the rods 173 can be displaced to and fro along the axis 139 by dog discs or through "dog chains" or the like guided over drums and levers corresponding to the levers 53 and 59, wherein one of the springs 141 acts as restoring spring. Furthermore, the rods 135 and 137 can be pivoted around the axis 139 in analogous manner as the rods 35 and 37.

Figure 14:
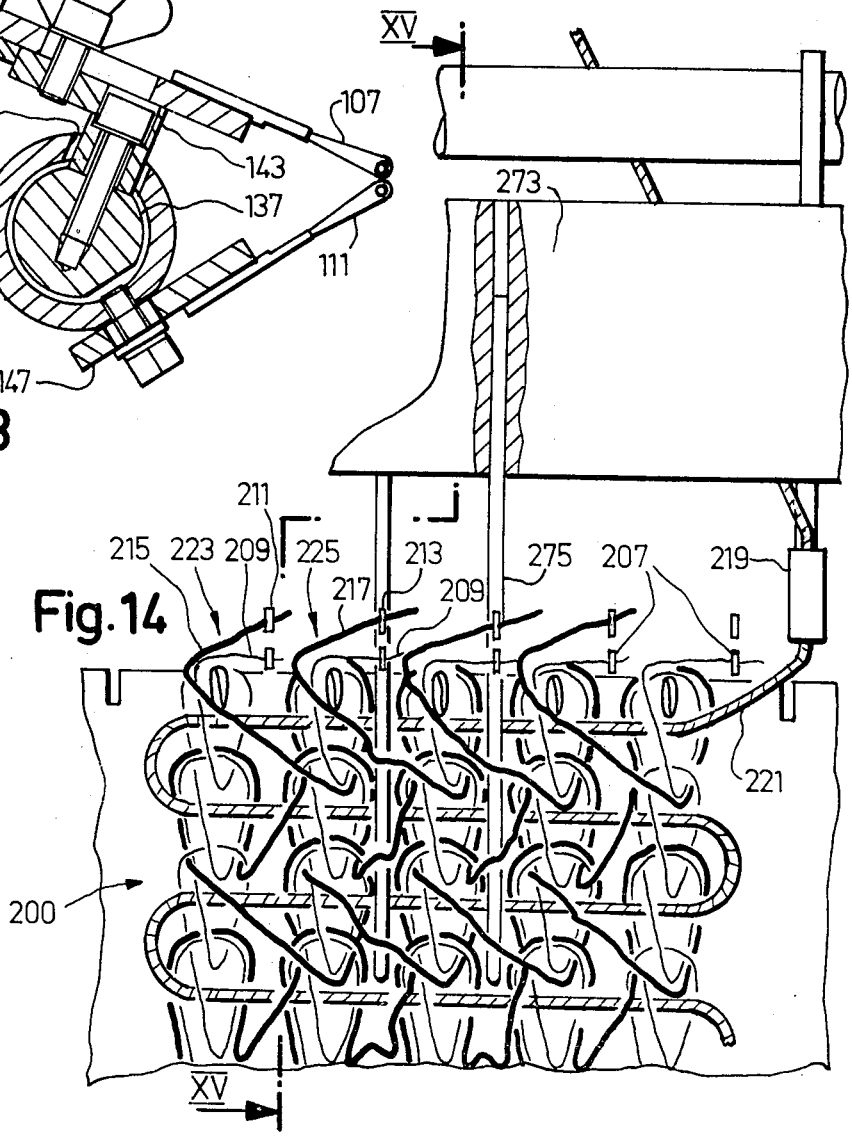
FIG. 14 is a plan view of a knitted article displaying a wale and parts of the crocheting machine serving for the production of this knitted article.
Figure 15:
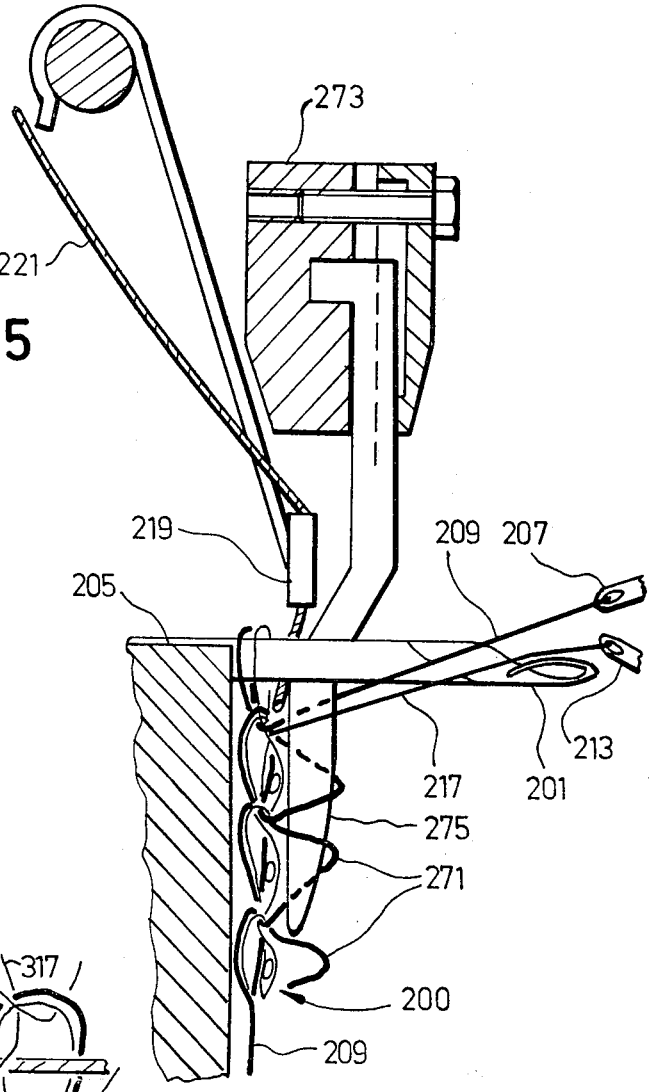
FIG. 15 is a section along the line XV—XV of the FIG. 14

Evident in FIGS. 14 and 15 is a knitted tape 200, which has stitch loop chains 223 and 225. Each stitch loop chain is formed from a basic warp thread 209 by means of a crochet needle 201 guided in a carrier 205 and a basic warp thread guide 207. The neighboring stitch loop chains are connected with each other in pairs by a respective additional warp thread 215 and 217 extending in zig-zag fashion. Furthermore, all stitch loop chains are connected with one another by a weft thread 221 extending transversely to them. The additional warp threads 215 and 217 are guided in additional warp thread guides 211 and 213, respectively. The weft thread 221 is guided in a weft thread guide 219.

The needles and the different thread guides are moved in analogous manner as was explained with reference to FIGS. 1 to 9. In the case of the tape 200, wale loops 271 are however formed of at least a part of the additional warp threads. For this purpose, lancets 275 are present, which are fastened to a holder 273 and which, between the carrier 205 and the warp thread guides, project through between two neighboring needles at right angles to the needles 201. When the additional warp thread guides move from one stitch loop chain to the stitch loop chain disposed to the right of this in FIG. 14, they lay the additional warp thread over the lancet possibly present between both these stitch loop chains, whereby just the wale loops 271 result.

The tape 200 can then for example be used together with another tape, which has mushroom-shaped or hookshaped knubs, to form a tape closure.

Figure 16:
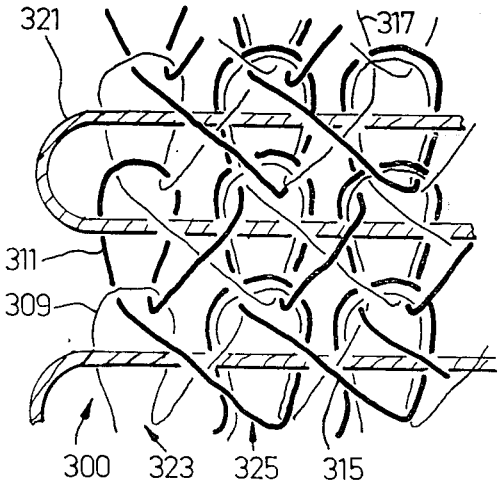
FIG. 16 is a schematic plan view onto a modification of a knitted article.

In FIG. 16, a tape 300 is shown with a weft thread 321 and stitch loop chains 323 and 325. In this tape, however, no warp threads are any longer present, which are worked into only a single stitch loop chain. The stitches of the stitch rod 323 are formed alternately from the warp threads 309 and 311, which run in zig-zag to and fro between both the stitch loop chains 323 and 325. The stitches of the stitch loop chain 325 are all formed of two respective warp threads, namely one of the warp threads 309 and 311 as well as a respective additional warp thread 315 and 317. Both the warp threads 315 and 317 then in their turn again run in zig-zag to and fro between the stitch loop chain 325 and the stitch loop chain disposed to the right of this. Since all warp threads in the case of the tape 300 thus extend in zig-zag, this tape receives a certain elastic deformability.

The tape 300 is produced by a similar method as explained with reference to FIGS. 1 and 8. The difference between both the methods consists in that for the production of the tape 300 also the threaded guides corresponding to the basic warp thread guides 7 are displaced in such a manner that the threads guided by them alternately form stitches of two different stitch loop chains. Both the rows of warp thread guides are then moved both substantially equally, wherein however, both courses of motion are displaced relatively to each other in time.

The production method can also still be modified in other manner. One can for example additionally still work threads of a rubber-elastic material into the fabric so that the knitted article becomes elastic.

I claim:

1. A knitting machine comprising:

a frame;

a plurality of needles;

a needle carrier connected to said frame for movably carrying said needles, said plurality of needles including at least one needle at an end of said needle carrier and a plurality of intermediate needles, said needles reciprocally movable on said carrier to form stitches with each movement of said needles;

two elongated members mounted to said frame and pivotable about a common pivot axis, said elongated members being axially displaceable along the pivot axis relative to each other;

connecting means interconnecting said elongated members for securing them against rotational movement relative each other;

a first row of thread guides mounted to one of said elongated members for guiding a first plurality of warp threads;

a second row of thread guides mounted to the other of said elongated members for guiding a second plurality of warp threads;

first drive means connected to said elongated members for pivoting said elongaged members about the pivot axis to move said first and second row of thread guides with respect to said plurality of needles for lifting the first and second plurality of warp threads above and lowering the first and second plurality of warp threads below said plurality of needles; and second drive means connected to said first and second elongated members for moving said first and second elongated members axially on the pivot axis and relative to each other;

said first and second drive means interengaged for synchronous operation so that two different warp threads of the first and second plurality of warp threads are laid around respective ones of said plurality of intermediate needles during each movement of said needles for forming a stitch with warp threads of one of the first and second plurality of warp threads being alternately laid around one of said intermediate needles and another one of said intermediate needles during a successive movement of the needles to form a successive stitch.

2. A knitting machine according to claim 1, wherein both of said elongated members are displaceable along the pivot axis relative to said frame, said second drive means comprising separate displacing elements for independently displacing each of said two elongated members along the pivot axis relative to said frame.

3. A knitting machine according to claim 2, wherein said separate displacing elements are disposed at mutually opposite ends of said two elongated members respectively.

4. A knitting machine according to claim 1, wherein said first drive means comprises a pivot arm non-rotatably connected to one of said elongated members.

5. A knitting machine according to claim 1, wherein one of said elongated members comprises an inner rod, the other of said elongated members comprises an outer, hollow rod, said inner rod being at least partly disposed in said outer rod, said outer rod having a plurality of openings extending therethrough and a support element connected to said inner rod through said openings, said support element carrying one of said first and second row of thread guides.

6. A knitting machine according to claim 1, including at least one weft thread guide mounted on said frame for displacement parallel to the pivot axis for laying a weft thread across the warp threads.

7. A knitting machine according to claim 6, wherein each of said needles has a longitudinal axis, said needles displaceable in said carrier in a direction parallel to each respective longitudinal axis and substantially transversely to the pivot axis, said weft thread guide being mounted for movement between said needle carrier and said first and second row of thread guides, and between said needles and said first and second row of thread guides when said needles are in a farthest position in said needle carrier away from the pivot axis so that said weft thread guide can lay a weft thread over said needles when said needles are in a position closer to the pivot axis.

8. A knitting machine according to claim 6, wherein said weft thread guide includes a weft thread outlet, said weft thread outlet movable independently from the pivoting of said elongated members about the pivot axis, through a plane in which said plurality of needles is contained.

9. A knitting machine according to claim 7, wherein said weft thread guide includes a weft thread outlet, said weft thread outlet movable independently from the pivoting of said elongated members about the pivot axis, through a plane in which said plurality of needles is contained.

10. A knitting machine according to claim 1, wherein each of said needles includes a shank and a hook contiguously connected to said shank, said hook having a free hook end extending back toward said shank at one side of the respective needle, all of said hooks being disposed on the same side of said shanks, said first and second drive means being operable to wrap stitch forming threads around the needles in a like rotational direction.

11. A knitting machine according to claim 10, wherein said shank at the hook-side end thereof includes a recess, said free hook end projecting into said recess within a cross-sectional outline of a shank part adjoining said recess.

12. A knitting machine according to claim 1, wherein said first and second drive means are operable to move each thread guide of one of said first and second row of thread guides to lay a thread around the same needle of said plurality of needles during all stitch forming movements of said needles, every thread guide of the other of said first and second row of thread guides laying a thread alternatively around two different needles during successive stitch forming movements of said needles.

13. A knitting machine according to claim 1, wherein said first and second drive means are operable to move each thread guide to wrap stitch forming threads alternatively around two different needles during successive stitch forming movements of said needles.

14. A knitting machine according to claim 1, including a plurality of lancets, each of said lancets projecting between two adjacent needles, said first and second drive means being operative to move said first and second row of thread guides to wrap a portion of a thread carried by each of said thread guides around one of said lancets between consecutive stitch forming movements of said needles from one stitch loop chain to an adjacent stitch loop chain thereby forming a wale loop.

* * * * *